US009131787B2

(12) United States Patent
Berglund et al.

(10) Patent No.: US 9,131,787 B2
(45) Date of Patent: Sep. 15, 2015

(54) MERCHANDISING UNIT AND SYSTEM

(71) Applicant: Process Retail Group, Inc., New Berlin, WI (US)

(72) Inventors: Terry Berglund, Hales Corners, WI (US); Dan Momsem, Milwaukee, WI (US); Chris Harrell, Wauwatosa, WI (US); M. Scott Bryson, Brookfield, WI (US)

(73) Assignee: Process Retail Group, Inc., New Berlin, WI (US)

( * ) Notice: Subject to any disclaimer, the term of this patent is extended or adjusted under 35 U.S.C. 154(b) by 0 days.

(21) Appl. No.: 13/927,783

(22) Filed: Jun. 26, 2013

(65) Prior Publication Data

US 2014/0001132 A1 Jan. 2, 2014

Related U.S. Application Data

(60) Provisional application No. 61/665,996, filed on Jun. 29, 2012.

(51) Int. Cl.

| | |
|---|---|
| ***A47B 43/00*** | (2006.01) |
| ***A47F 5/00*** | (2006.01) |
| *A47B 47/00* | (2006.01) |
| *A47F 1/12* | (2006.01) |
| *A47B 96/02* | (2006.01) |
| *A47B 97/00* | (2006.01) |

(52) U.S. Cl.

CPC ..... *A47F 5/0018* (2013.01); *A47F 5/0025* (2013.01); *A47B 47/00* (2013.01); *A47B 96/02* (2013.01); *A47B 97/00* (2013.01); *A47F 1/125* (2013.01); *A47F 5/005* (2013.01)

(58) Field of Classification Search

CPC ..... A47F 5/0018; A47F 5/0025; A47F 1/125; A47F 5/005; A47B 96/02; A47B 97/00; A47B 47/00

USPC ..... 211/59.1, 59.3, 119.003, 119.005, 113; 248/250, 220.21, 231.81, 220.22, 235; 24/458, 581.11, 292–295; 108/25–26, 108/106–108, 110

See application file for complete search history.

(56) References Cited

U.S. PATENT DOCUMENTS

| | | | | | |
|---|---|---|---|---|---|
| 219,713 | A | * | 9/1879 | Goodyear | 211/125 |
| 806,805 | A | * | 12/1905 | Hardin | 118/31 |
| 981,269 | A | * | 1/1911 | Hurff | 211/125 |
| 995,798 | A | * | 6/1911 | McCullough | 118/31 |
| 1,045,407 | A | * | 11/1912 | Hurff | 211/125 |
| 1,093,856 | A | * | 4/1914 | Hurff | 211/125 |
| 1,095,006 | A | * | 4/1914 | Lowe | 211/125 |

(Continued)

*Primary Examiner* — Jonathan Liu
*Assistant Examiner* — Devin Barnett
(74) *Attorney, Agent, or Firm* — Andrus Intellectual Property Law, LLP

(57) ABSTRACT

A shelf clamp for connecting a rack unit to a display shelf has a flat body with a clasp extending from the top end of the flat body, a support lip extending from the mid-section of the flat body, and a front fin extending diagonally upward from the front face of the flat body, wherein the front fin is comprised of flexible material such that the front fin can flex towards the flat body. The bottom end of the shelf clamp is fashioned to slide down between an edge of the shelf and a wall, causing the front fin to flex upward toward the flat body as it presses between the shelf and the wall, and then return to its diagonally upward position once it passes the shelf. Thereby, the shelf clamp engages the edge of the shelf and the support rib and the front fin.

25 Claims, 15 Drawing Sheets

(56) References Cited

U.S. PATENT DOCUMENTS

| | | | | | |
|---|---|---|---|---|---|
| D91,319 | S | * | 1/1934 | Falk | D6/316 |
| D93,143 | S | * | 8/1934 | Spragg | D6/320 |
| 2,066,822 | A | * | 1/1937 | Cohen | 211/13.1 |
| 3,131,447 | A | * | 5/1964 | Tinnerman | 248/231.81 |
| 3,592,343 | A | * | 7/1971 | Swett et al. | 211/123 |
| 3,626,553 | A | * | 12/1971 | Darney | 280/814 |
| 4,027,799 | A | * | 6/1977 | Stucker | 211/13.1 |
| 4,428,486 | A | * | 1/1984 | Collins | 211/119 |
| 4,474,316 | A | * | 10/1984 | Philibert | 223/88 |
| 4,630,338 | A | * | 12/1986 | Osterland et al. | 24/293 |
| 4,765,575 | A | * | 8/1988 | Bergl et al. | 248/250 |
| 4,865,281 | A | * | 9/1989 | Wollar | 248/71 |
| 5,012,936 | A | * | 5/1991 | Crum | 211/59.3 |
| 5,123,546 | A | * | 6/1992 | Crum | 211/59.3 |
| 5,150,865 | A | * | 9/1992 | Miller | 248/71 |
| 5,505,315 | A | * | 4/1996 | Carroll | 211/59.2 |
| 5,509,634 | A | * | 4/1996 | Gebka et al. | 248/316.7 |
| 5,526,553 | A | * | 6/1996 | Klein | 24/295 |
| 5,645,176 | A | * | 7/1997 | Jay | 211/59.2 |
| 5,655,670 | A | * | 8/1997 | Stuart | 211/43 |
| 5,665,304 | A | * | 9/1997 | Heinen et al. | 312/71 |
| 5,671,851 | A | * | 9/1997 | Johnson et al. | 211/51 |
| 5,730,320 | A | * | 3/1998 | David | 221/279 |
| 5,855,283 | A | * | 1/1999 | Johnson | 211/59.3 |
| 5,887,319 | A | * | 3/1999 | Smith | 24/293 |
| 5,957,422 | A | * | 9/1999 | Shea | 248/220.31 |
| 5,987,714 | A | * | 11/1999 | Smith | 24/295 |
| D420,842 | S | * | 2/2000 | Thurston-Chartraw | D6/513 |
| 6,102,192 | A | * | 8/2000 | Tomuro et al. | 198/747 |
| 6,141,837 | A | * | 11/2000 | Wisniewski | 24/295 |
| 6,186,456 | B1 | * | 2/2001 | Marsh | 248/243 |
| 6,279,207 | B1 | * | 8/2001 | Vassiliou | 24/293 |
| 6,286,690 | B1 | * | 9/2001 | Thalenfeld | 211/113 |
| 6,439,404 | B1 | * | 8/2002 | Steeg | 211/87.01 |
| 6,443,316 | B1 | * | 9/2002 | Mao | 211/74 |
| 6,523,703 | B1 | * | 2/2003 | Robertson | 211/59.3 |
| 6,769,552 | B1 | * | 8/2004 | Thalenfeld | 211/59.3 |
| 7,004,436 | B2 | * | 2/2006 | Knapp | 248/220.22 |
| 7,183,496 | B2 | * | 2/2007 | Arrigotti et al. | 174/260 |
| 7,219,459 | B2 | * | 5/2007 | Valiulis et al. | 40/673 |
| 7,278,189 | B2 | * | 10/2007 | Smith | 24/295 |
| 7,284,671 | B1 | * | 10/2007 | Doscher | 211/59.1 |
| 7,320,157 | B2 | * | 1/2008 | Lubera et al. | 24/295 |
| 7,540,244 | B2 | * | 6/2009 | Gregory | 108/108 |
| 7,690,519 | B2 | * | 4/2010 | Kahl et al. | 211/59.2 |
| 7,725,991 | B2 | * | 6/2010 | Lubera et al. | 24/295 |
| 7,849,567 | B2 | * | 12/2010 | Dickenson et al. | 24/293 |
| 7,891,926 | B2 | * | 2/2011 | Jackson, Jr. | 411/510 |
| 7,909,183 | B2 | * | 3/2011 | Oh | 211/59.1 |
| 8,152,119 | B2 | * | 4/2012 | Pfund et al. | 248/220.43 |
| 8,152,405 | B2 | * | 4/2012 | Dubost | 403/388 |
| 8,307,596 | B2 | * | 11/2012 | Catalano | 52/456 |
| 8,413,823 | B2 | * | 4/2013 | Hardy | 211/59.3 |
| 8,439,208 | B2 | * | 5/2013 | Niederhuefner et al. | 211/51 |
| 8,453,851 | B2 | * | 6/2013 | Ciesick | 211/59.3 |
| 8,458,862 | B2 | * | 6/2013 | Reznar | 24/292 |
| 8,469,438 | B2 | * | 6/2013 | Mazur et al. | 296/146.7 |
| 8,474,107 | B2 | * | 7/2013 | Baumgartner et al. | 24/295 |
| D705,046 | S | * | 5/2014 | Ifko | D8/394 |
| 8,720,702 | B2 | * | 5/2014 | Nagel | 211/59.3 |
| 8,746,472 | B2 | * | 6/2014 | Thrush | 211/94.01 |
| 2003/0098403 | A1 | * | 5/2003 | Fox | 248/538 |
| 2003/0196974 | A1 | * | 10/2003 | Cuzzocrea | 211/113 |
| 2004/0140278 | A1 | * | 7/2004 | Mueller et al. | 211/59.3 |
| 2005/0035075 | A1 | * | 2/2005 | Walker | 211/119.003 |
| 2005/0279722 | A1 | * | 12/2005 | Ali | 211/59.3 |
| 2006/0022100 | A1 | * | 2/2006 | Lan | 248/220.21 |
| 2006/0186065 | A1 | * | 8/2006 | Ciesick | 211/59.3 |
| 2006/0196840 | A1 | * | 9/2006 | Jay et al. | 211/59.2 |
| 2007/0170127 | A1 | * | 7/2007 | Johnson | 211/59.3 |
| 2007/0267366 | A1 | * | 11/2007 | Howerton et al. | 211/59.3 |
| 2007/0267367 | A1 | * | 11/2007 | Mueller et al. | 211/59.3 |
| 2008/0017600 | A1 | * | 1/2008 | Thompson | 211/119.003 |
| 2008/0074021 | A1 | * | 3/2008 | Croft et al. | 312/334.1 |
| 2008/0271297 | A1 | * | 11/2008 | Dubost | 24/293 |
| 2008/0289155 | A1 | * | 11/2008 | Kim et al. | 24/295 |
| 2009/0223916 | A1 | * | 9/2009 | Kahl et al. | 211/85.4 |
| 2009/0277853 | A1 | * | 11/2009 | Bauer | 211/59.3 |
| 2010/0019114 | A1 | * | 1/2010 | Vargo | 248/309.1 |
| 2010/0213333 | A1 | * | 8/2010 | Mejia et al. | 248/220.21 |
| 2011/0062096 | A1 | * | 3/2011 | Sparkowski | 211/59.3 |
| 2011/0210086 | A1 | * | 9/2011 | Ciesick | 211/59.3 |
| 2011/0215060 | A1 | * | 9/2011 | Niederhuefner | 211/59.3 |
| 2011/0215061 | A1 | * | 9/2011 | Niederhuefner et al. | 211/59.3 |
| 2011/0218889 | A1 | * | 9/2011 | Westberg et al. | 705/28 |
| 2012/0273434 | A1 | * | 11/2012 | Niederhuefner et al. | 211/4 |
| 2013/0032559 | A1 | * | 2/2013 | Gregory et al. | 211/113 |
| 2013/0068708 | A1 | * | 3/2013 | Johnson et al. | 211/59.3 |
| 2013/0112634 | A1 | * | 5/2013 | Nagel | 211/59.3 |
| 2013/0117973 | A1 | * | 5/2013 | Murasaki et al. | 24/581.11 |
| 2013/0193095 | A1 | * | 8/2013 | Nagel | 211/59.3 |
| 2013/0240467 | A1 | * | 9/2013 | Ciesick | 211/59.3 |
| 2013/0270204 | A1 | * | 10/2013 | Bird et al. | 211/59.3 |
| 2013/0270205 | A1 | * | 10/2013 | Daw | 211/59.3 |
| 2014/0166598 | A1 | * | 6/2014 | Bird et al. | 211/4 |
| 2014/0167962 | A1 | * | 6/2014 | Valiulis et al. | 340/568.8 |

* cited by examiner

MERCHANDISING UNIT AND SYSTEM

CROSS-REFERENCE TO RELATED APPLICATION(S)

The present application claims priority of U.S. Provisional Patent Application No. 61/665,996, filed Jun. 29, 2012, the content of which is incorporated herein by reference in its entirety.

U.S. patent Ser. No. 12/729,768 is hereby incorporated herein by reference and discloses a glide floor assembly that ma be used in conjunction with a shelf or display for containers or packages in a retail environment.

FIELD

The present disclosure relates to improved merchandising units and systems for holding and displaying merchandise, and more specifically to merchandising units and systems for holding packaged foods, such as packaged produce in a grocery refrigerator case.

BACKGROUND

Retailers in many retail sectors use merchandizing units to display merchandise. For example, grocery stores use merchandising units to hold and organize foods on shelves and in displays. Further, grocers use merchandising units in their refrigerators and freezers to organize and display refrigerated and frozen foods. Such units may be in closed refrigerators, such as refrigerators with glass doors, or in open refrigerator cases, such as those that house fresh produce and meats. For instance, grocers use merchandising racks to display bags and boxes of produce, such as bags of frozen fruit and boxes of salad.

SUMMARY

The present disclosure stems from the inventors research and development of improved systems and methods for increasing the efficiency and effectiveness of merchandising units, especially units for grocery refrigerators, and also for simplifying such merchandising units. The present inventors have recognized that prior art merchandising units available for grocer refrigerators are complicated and often require special build out or infrastructure to be installed in the grocery refrigerator before the merchandising unit can be used. Such infrastructure is costly and inefficient. Further, such infrastructure often causes damage to the existing refrigerator shelves and/or walls, such as holes being drilled therein which can lead to rust and/or degradation of the integrity of the refrigerator. Thus, the present inventors recognize that merchandising units and systems are needed for displaying products on grocery shelves, such as in grocery refrigerators, that utilize a stores existing shelf structure, for example by attaching to the existing shelf structure without damaging the shelves and without requiring special tools or significant infrastructure.

Through their research and development, the inventors invented improved merchandising units and systems for grocery refrigerators which are attachable to any standard shelf, which are described and depicted in this disclosure. The clamp and rack system described herein is engineered to meet the unique demands of the soft packaged food product industry, and specifically the packaged produce category; however, the inventors contemplate that the clamp and rack system is suitable for displaying a wide range of products on grocery shelves. The inventive clamp and rack system carefully considers the demands and economics of the category, including economy of space, the rigors of shipping and stocking, product perishability, communication, and implementation.

One embodiment relates to a shelf clamp for connecting a rack unit to a display shelf, such as for merchandising foods. The shelf clamp comprises a flat body having a front face, a back face, a top end, and a bottom end. The shelf clamp also comprises a clasp extending from the top end of the flat body, a support rib extending from a mid-section of the flat body, and a front fin extending diagonally upward from the front face of the flat body, wherein the front fin is comprised of a flexible material such that the front fin can flex toward the flat body. The shelf clamp is fashioned such that the bottom end of the shelf clamp slides down between an edge of a shelf and a wall, causing the front fin to flex toward the flat body as it passes between the shelf and the wall, and then returns to its diagonally upward position once it passes the shelf. Thereby, the shelf clamp engages the edge of the shelf between the support rib and the front fin.

Another embodiment relates to a clamp system for connecting a rack unit to a display shelf, such as for merchandising food. The clamp system comprises a face shelf clamp and an extension bar. The face shelf clamp has a flat body with a front face, a back face, a top end, and a bottom end. The shelf clamp also has a clasp at the top end of the flat body, a support rib extending perpendicular from a mid-section of the flat body, and a front fin extending diagonally upward from the front face of the flat body. The first shelf clamp fastens to the end of a shelf by engaging the shelf between the support rib and the front tin. The extension bar portion of the clamp system attaches to the first shelf clamp such that the extension bar is positioned above the shelf. The extension bar is an elongated body having an elongated clasp extending thereacross and providing a continuous connection point for attaching a rack unit to the shelf.

Yet another embodiment relates to a clamp and rack system for holding packaged foods on a shelf, such as a shelf in a grocer refrigerator. The clamp and rack system comprises a shelf a first clamp, and a rack unit. The first clamp attaches to the shelf and has a flat body that extends perpendicularly up from the shelf and a clasp connected to the flat body that extends above the shelf. The rack unit removably connects to the first clamp and is thereby secured to the shelf. The rack unit has a drawer for holding, packaged foods and a connective that removably engages the clasp of the first clamp.

Various other features, objects and advantages of the invention will be made apparent from the following description taken together with the drawings.

BRIEF DESCRIPTION OF THE FIGURES

FIG. 5A illustrates a rack unit removably connected to a shelf by a clamp system including two shelf clamps and an extension bar. FIG. 5B illustrates a side angle view of the system having an exemplary connection between an embodiment of a shelf clamp, an extension bar, and a rack unit. FIG. 5C illustrates an exemplary depiction of the installation of a rack unit to a shelf using an embodiment of the clamp and rack system.

FIGS. 7A and 7B illustrates an additional another embodiment of a clamp system for connecting a rack unit to a shelf, wherein FIG. 7A illustrates a front view of the embodiment and FIG. 7*b* depicts a side view of the same embodiment.

FIG. 8A shows a top view of an embodiment of a rack unit, and FIG. 8B illustrates a side angle view of the embodiment connected to an embodiment of a shelf clamp. FIG. 8C illustrates an embodiment of a rack unit having a telescoping function and connected to an embodiment of a shelf clamp.

DETAILED DESCRIPTION OF THE FIGURES

In the present description, certain terms have been used for brevity, clarity, and understanding. No unnecessary limitations are to be implied therefrom beyond the requirements prior art because such terms are used for descriptive purposes only and are intended to be broadly construed. The different systems and methods described herein may be used alone or in combination with other systems and methods. Various equivalents, alternatives, and modifications are possible within the scope of the appended claims.

Figure 1:
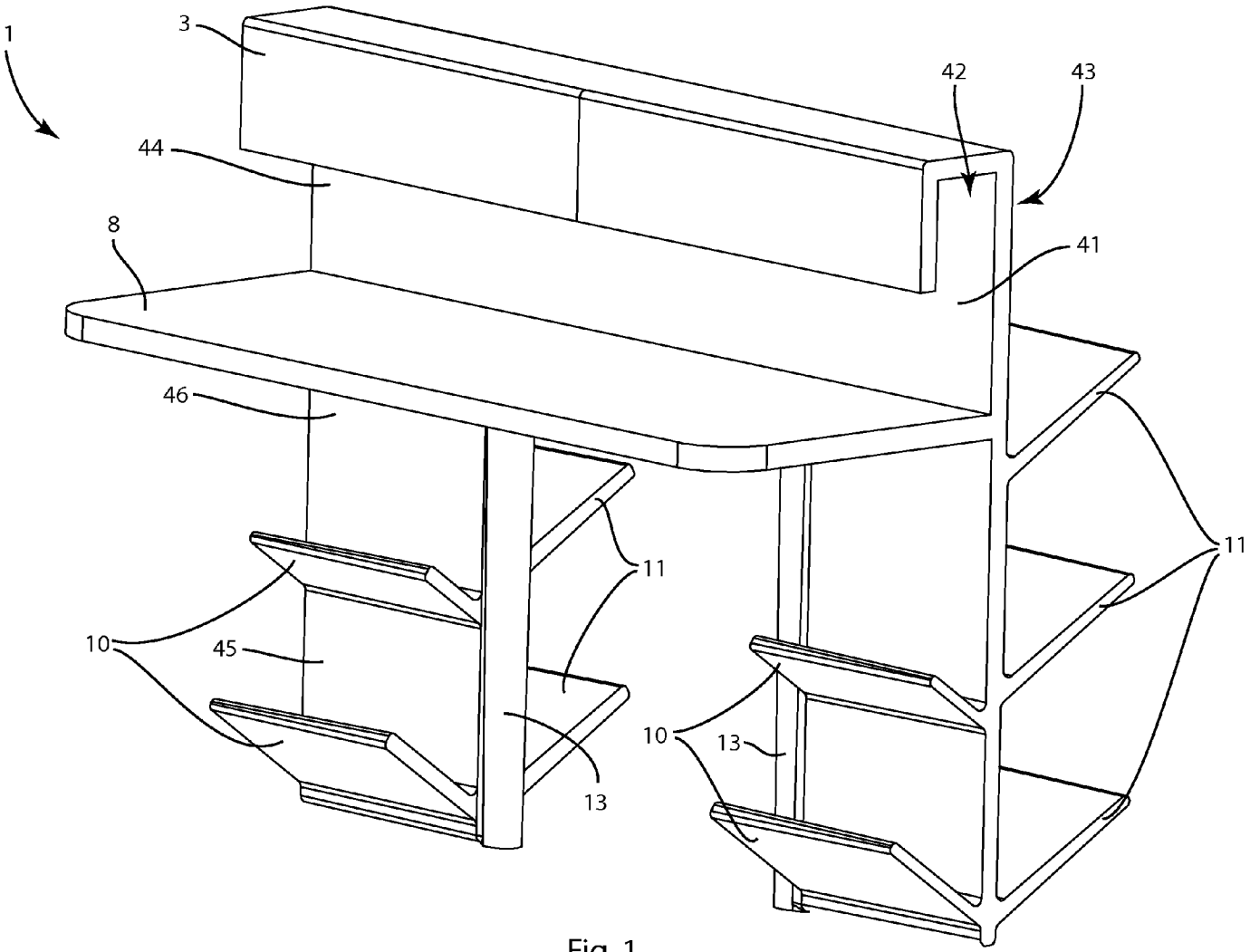
FIG. 1 illustrates an embodiment of a shelf clamp for connecting a rack unit to a shelf of the present application.
Figure 2A:
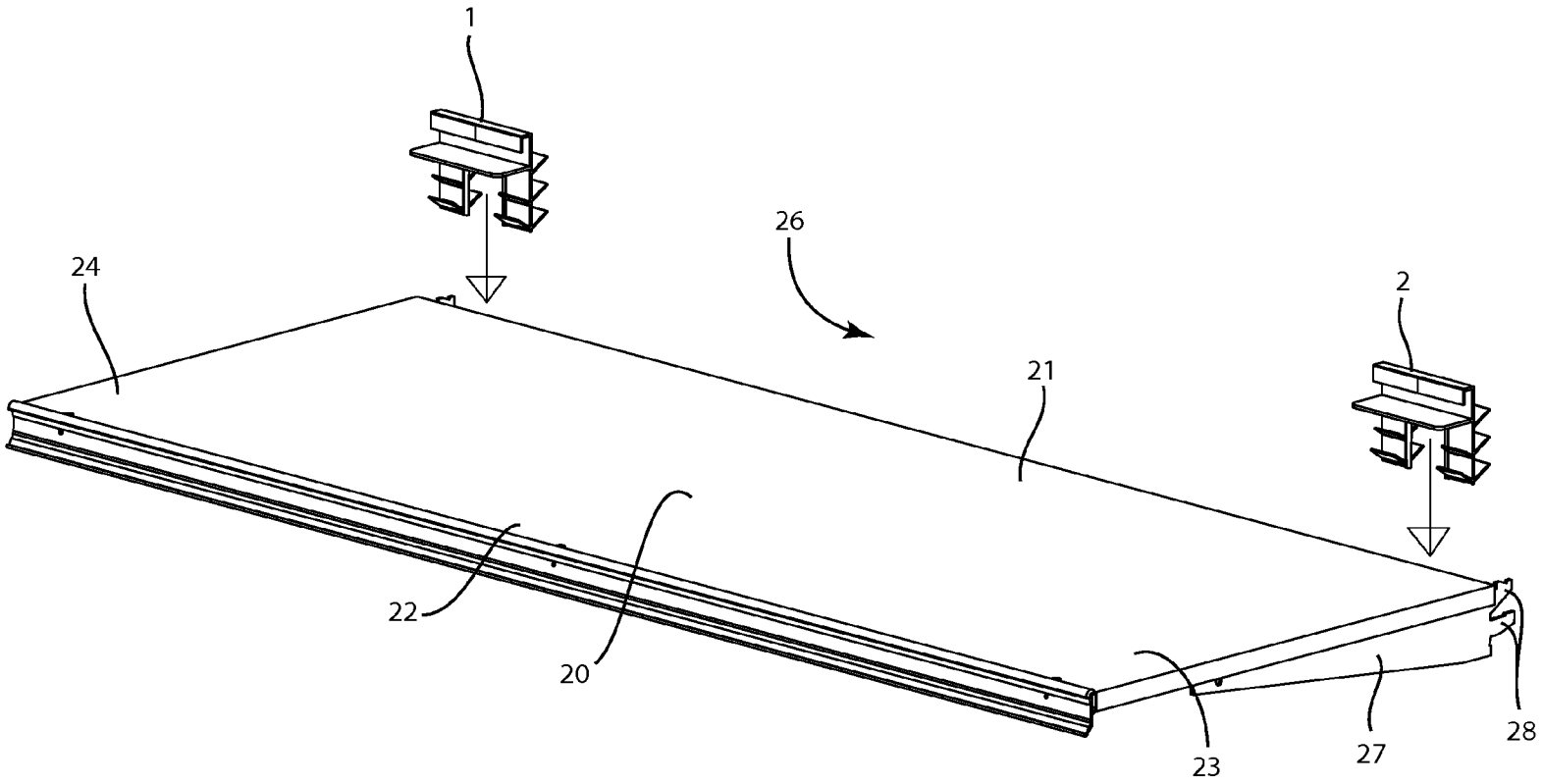
FIGS. 2A and 2B illustrate an exemplary installation of shelf clamps onto a shelf.
Figure 2B:
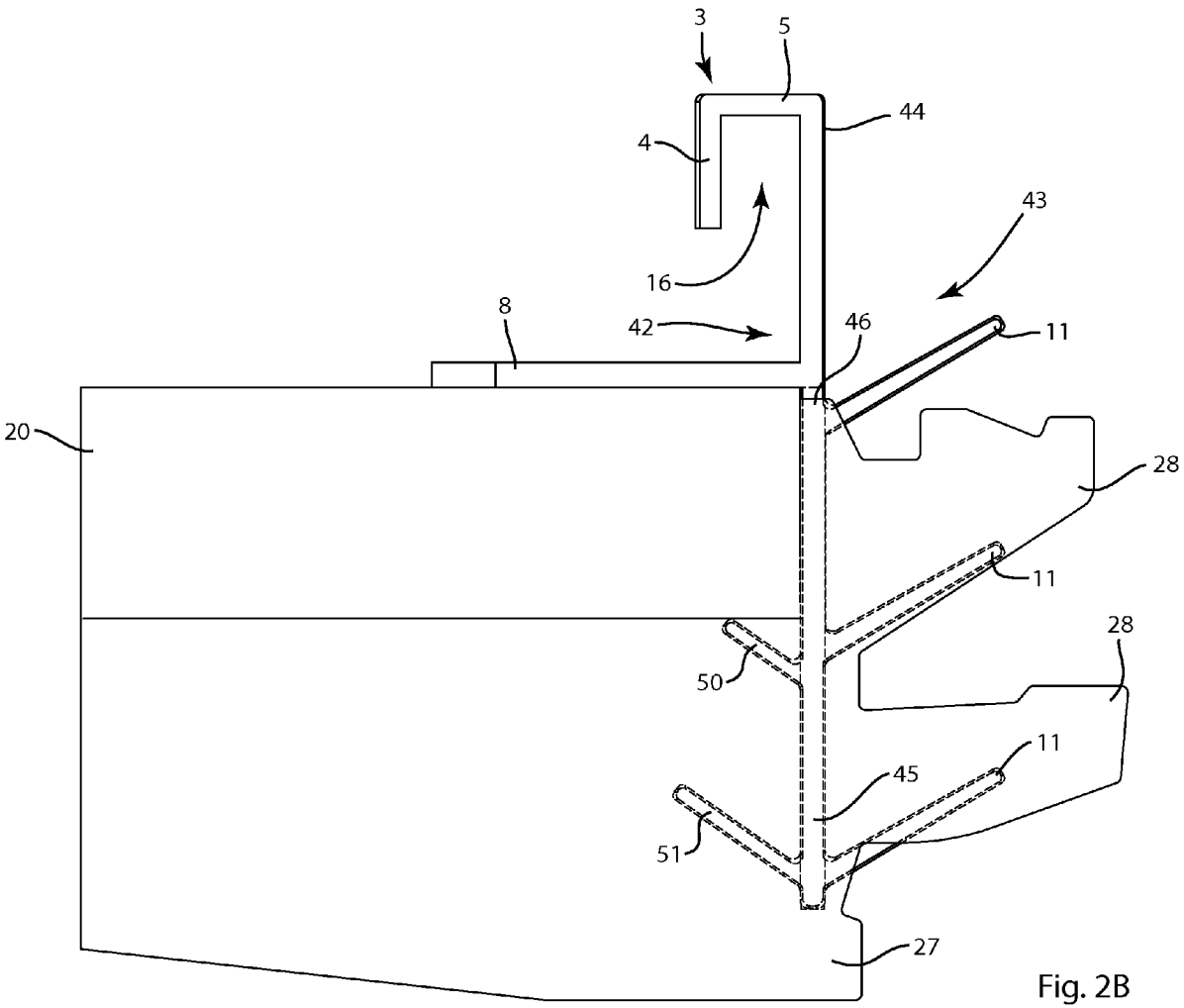
Figure 5A:
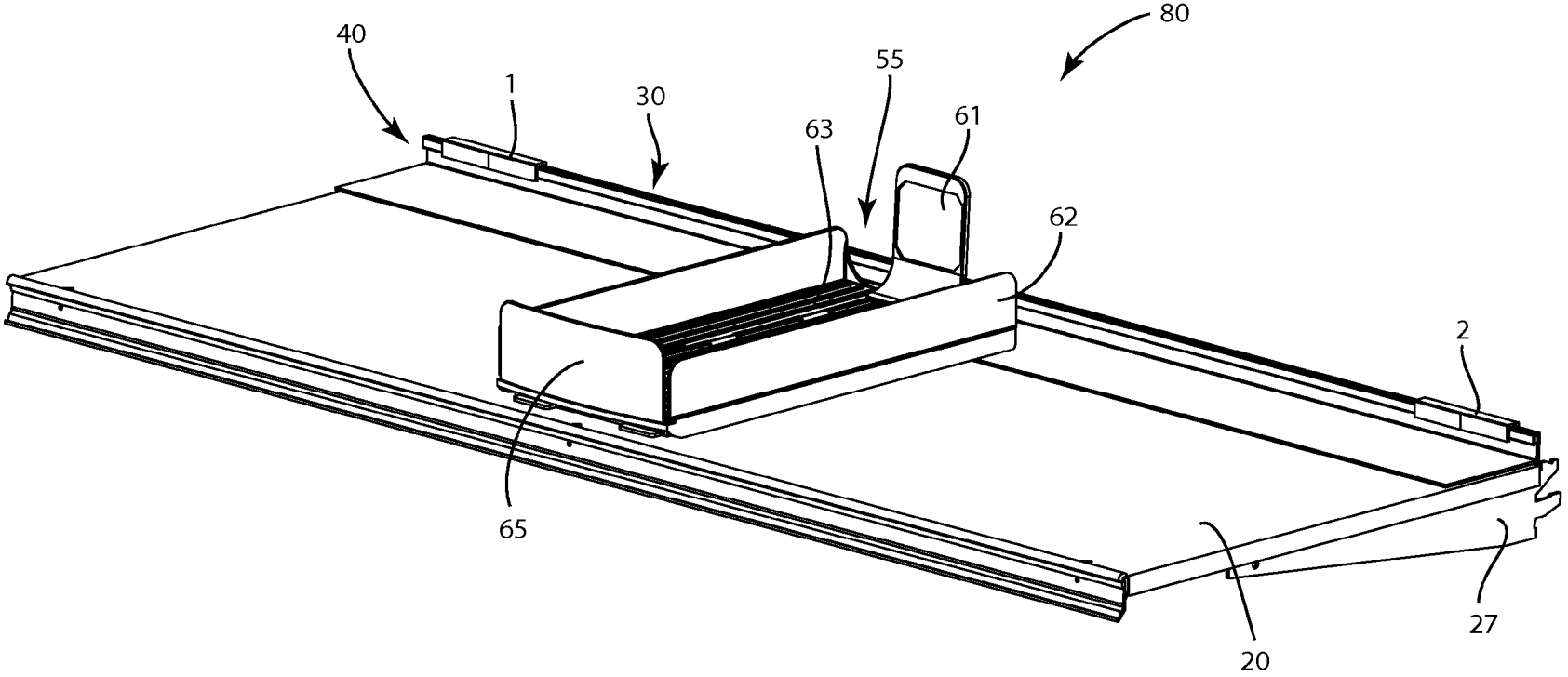
FIGS. 5A-5C illustrate an embodiment of a clamp and rack system for holding packaged foods.

FIG. 1, as well as FIGS. 2A-2B, depict an embodiment of a shelf clamp 1. The shelf clamp 1 is fashioned to fasten or engage a shelf 20, such as a refrigerator shelf, in order to fasten a rack unit 55 to the shelf 20. In the embodiment of FIG. 1 the shelf clamp 1 has a flat body 41. The flat body 41 of the shelf clamp 1 has a front face 42, a back face 43, a top end 44, a mid-section 46, and a bottom end 45. The front face 42 faces the shelf 20 when the shelf clamp 1 is engaged with the shelf 20. The back face 43 of the shelf clamp 1 faces the wall or body upon which the shelf 20 is mounted when the shelf clamp 1 is engaged with the shelf 20. The shelf clamp 1 has a clasp 3 extending from the top end 44 of the flat body 41. The shelf clamp 1 also has a support lip 8 and at least one front fin 10. The support lip 8 and front fin 10 are designed to engage an edge of a shelf 20 in order to secure the shelf clamp 1 to the shelf 20. When the shelf clamp 1 is secured to or engaging a shelf 20, the clasp 3 extends above the shelf 20 and serves to connect to a rack unit 55, or a clamp system 40 (FIG. 5A) that connects to a rack unit 55 in order to secure the rack unit 55 to the shelf 20.

As depicted in FIGS. 2A and 2B, the shelf clamp 1 engages the shelf 20 with the support lip 8 and at least one front fin 10. Specifically, the support lip 8 extends from the mid-section 46 of the flat body 41 and is fashioned to engage the top portion of the edge of the shelf, such as the back edge 21. In one embodiment, the support lip 8 is a rigid, flat lip that extends perpendicularly from the mid-section 46 of the flat body 41. Preferably, the support lip 8 is rigid, enough such that normal loads and torque placed on the shelf clamp 1, such as by a rack unit 55 fully loaded with food, will not drive the shelf clamp 1 to bend forward or change position with respect to the shelf 20. In another embodiment, the support lip 8 could be a downward-facing fin extending diagonally downward from the front face 42 of the flat body 41. In that embodiment, the support lip 8 would engage a top edge of the shelf 20 and would be rigid enough so that the diagonally extending shelf lip 8 would not flex upward when pressed against the top of the shelf 20. In yet another embodiment, the support lip 8 could be one or more rounded protrusions, or bulges, extending from the front face 42 of the flat body 41. The protrusion or bulge would be large enough to securely engage the top edge of the shelf 20 to support the shelf clamp 1 and prevent it from slipping downward between the shelf 20 and the wall 26. The wall 26 could be any surface upon which the shelf 20 is mounted. For example, the wall 26 could be a wall of a grocer refrigerator or freezer, or a gondola back panel. Alternatively, the wall 26 could be a wall of a shelving unit or a shelving bracket upon which the shelf 20 is mounted. In still other embodiments, the wall 26 could be the wall of a building.

The shelf clamp 1 also engages the shelf 20 using one or more front fins 10 which extend diagonally up from the front face 42 to the flat body 41. As depicted in FIG. 2*b*, the front fin 10 pushes upward on the bottom of the shelf 20, such as on the bottom side of the back edge 21. The shelf clamp 1 may also have one or more back fins extending diagonally upward from the back face 43 of the flat body 41. The back fin 11 is designed to push out against the wall on which the shelf 20 is mounted so as to keep the shelf clamp 1 folded and engaged with the shelf 20.

The shelf clamp 1 is designed to be inserted between the edge of a shelf 20 and a wall 26 to which the shelf is mounted. For example, as depicted in FIG. 2A, one or more shelf clamps 1 can be inserted into the space between a back edge 21 of the shelf 20 and a wall 26. During insertion, the one or more front fins 10 and back fins 11 may flex upward toward the flat body 41 to allow the shelf clamp 1 to slide between the shelf 20 and the wall 26. The front fins 10 and back fins 11 may be made of a flexible material that allows the fins 10,11 to flex upwards in response to a force in the upward direction, but causes the fins 10,11 to return to its original position once the force is removed. Furthermore, in the preferred embodiment, the fins 10, 11 are designed so that they only flex in an upward direction and do not flex in the downward or opposite direction in response to downward pressure. For example, the front fins 10 preferably do not flex downward when the shelf clamp 1 is pulled in the upward direction causing the front fin 10 to press against the bottom edge of the shelf 20. Avoiding such a downward flex allows the front fin 10 to secure the shelf clamp 1 to the shelf 20 so that the shelf clamp 1 cannot be easily disengaged from the shelf 20 by simply pulling upward on the shelf clamp 1.

In an embodiment of the shelf clamp 1 having one or more back fins 11, the back fins 11 may also flex upward toward the back face 43 of the flat body 41 when the shelf clamp is inserted between a shelf 20 and a wall 26. Depending on the amount of space between the shelf 20 and the wall 26, the back fins 11 flex upward in response to pressure exerted by the wall 26. Unlike the front fins 10, the back fins 11 may not return to their original position once the shelf clamp 1 has engaged with the shelf 20 because the back fins 11 may continue to receive pressure from the wall 26 that causes the back fins 11 to remain in an upward flexed position. In that situation, the flexed back fins 11 will continually exert force against the wall 26 which will press the shelf clamp 1 forward toward the edge of the shelf 20 in order to keep the shelf clamp 1 firmly engaged with the shelf 20. Alternatively, if there is a large space between the shelf 20 and the wall 26, the back fins 11 may not remain flexed upward when the shelf clamp 1 is engaged with the shelf 20. In yet another situation, if the wall 26 has ridges, or indentations, one or more of the back fins 11 may extend into the ridged space of the wall 26, which would allow that back fin 11 to further engage the wall 26 and provide additional securement of the shelf clamp 1.

The shelf clamp 1 must have at least one front fin 10 to secure the shelf clamp 1 against the bottom edge of the shelf 20. However, the shelf clamp 1 can otherwise have any number of front fins 10 or back fins 11. In designs having multiple front fins 10, the shelf clamp 1 may be suitable for engaging with multiple different shelves 20 having different depths, or thicknesses. For example, the shelf clamp 1 depicted in FIGS. 1, and 2A and 2B, has two sets of front fins, first front fins 50 and second front fins 51. As best seen in FIG. 2B, the first front tins 50 would engage a narrower shelf 20 than the second front fins 51.

The back fins 11 may be longer than the front fins 10 so that the back fins 11 can stretch various distances between a shelf 20 and wall 26 to maintain pressure on the wall 26 and keep the shelf clamp 1 in a forward position against the shelf 20. Additionally, the back fins 11 may be more flexible than the front fins 10, such that the back fins 11 flex upward toward the back face 43 of the flat body 41 more readily than the respective flex of the front fins. Alternatively, another embodiment of the shelf clamp 1 does not have any back fins 11. In such an embodiment, the front fin 10 and/or the support lip 8 would be long enough to allow some motion of the clamp between the shelf 20 and the wall 26 without allowing the shelf clamp 1 to become disengaged from the shelf 20. For example, in an embodiment wherein the support lip and the front fin 10 are elongated, the shelf clamp 1 could slide back towards the wall 26 such that a space is created between the flat body 41 and the back edge 21 of the shelf 20. As long as the support lip 8 and the front fin 10 are long enough and rigid enough to remain engaged with the back edge 21 of the shelf, the shelf clamp 1 will remain securely engaged with the shelf 20.

The clasp 3 may be any clasp known in the art that would be appropriate for removably engaging a rack unit 55, such as a refrigerator rack. For example, the clasp 3 could be a female connector configured to receive a male connector on a rack unit 55. Alternatively, the clasp could be a male connector configured to be received by, or mate with, a female connector on a rack unit 55. In one embodiment depicted in FIGS. 1 and 2, the clasp 3 is a right angle hook that engages, or hooks, a connection member of the clamp and rack unit 55 disclosed herein, such as to the connector 58 of a rack unit 55 or to an extension bar 30. In the depicted embodiment of FIGS. 1 and 2, a right angle hook clasp 3 extends from the top end 44 of the flat body 41, having a top side 5 that extends perpendicularly from the top of the flat body 41. A front side 4 of the clasp 3 then extends perpendicularly downward from the top side 5 such that the clasp top 5 and the clasp from 4 create a right angle hook that can engage a member sized to fit within the hook space 16.

For example, the right angle hook embodiment of the clasp 3 may receive a connector 58 of the rack unit 55 to secure the rack unit 55 to the shelf 20. In such an embodiment, the connector 58 (FIG. 5B) may be a rectangular-shaped male connector sized to fit within the hook space 16, and thereby to be engaged by, or mate with, the right angle hook embodiment of the clasp 3. Alternatively, the connector 58 could be a smaller right angle hook that fits within the right angle hook embodiment, of the clasp 3, thereby engaging the clasp to secure the rack unit 55 to the shelf 20. (See, e.g., FIG. 4.) Alternatively, the clasp 3 could be a rounded hook, or a triangular-shaped hook. In a further embodiment, the clasp 3 could be a flat protrusion, such as a flat bar, that extends backward from the top end 44 of the flat body 41. In such an embodiment, the connector 58 of the rack unit 35 could then be a hook, such as a right angle hook, that extends around and engages the protrusion. In still other embodiments, the clasp 3 could take on any shape that would allow for connection, either directly or indirectly, to a connector 58 of a rack unit 55.

As demonstrated in FIG. 1, one embodiment of the shelf clamp 1 has two legs 13 on the bottom end 45 of the flat body 41. The legs 13 may hold the fins 10 and 11 such that the fins 10 and 11 may extend out from the front face 42 and back face 43 of the legs 13. The dual leg design of the shelf clamp 1, as opposed to a shelf clamp having a solid bottom end 45, may provide benefits including more flexibility in where to place the shelf clamp 1. The leg design allows for the shelf clamp to avoid certain obstacles that may be on a shelf 20 or a wall 26, such as a shelf hook 27 or any bolt, hook, or other protrusion extending from a shelf 20 or wall 26. In that instance, the shelf clamp 1 can be inserted such that the obstacle falls between the legs 13 of the flat body 41. Conversely, where the shelf clamp 1 has a solid bottom end 45 of the flat body 41, the shelf clamp 1 must be placed to avoid the obstacle entirely. In still another embodiment, the shelf clamp 1 has only one leg 13 at the bottom end 45 of the flat body 41. The single leg 13 may have one or more front fins 10, and may also have one or more back fins 11. The shelf 20 may be any shelf existing in a grocer refrigerator. For example, as shown in FIG. 2A, the shelf 20 may be a rectangular, flat shelf having a right side 23 and a left side 24, as well as a back edge 21 and a front edge 22. The shelf 20 may be mounted in a refrigerator by a shelf hook 27. The shelf hook 27 may have tangs 28 that extend out from the back of the shelf hook 27 and are shaped to engage with a shelf bracket or frame inside the refrigerator.

The shelf clamp 1 may be of material suitable for the above-described purposes and functions. In a preferred embodiment, the shelf clamp 1 is comprised of polypropylene and the shelf clamp is molded as a single piece. In other embodiments, the shelf clamp could be comprised of other materials, such as PVC or other plastic.

The shelf clamp 1 may be part of a shelf clamp system 40 including an extension bar 30 attached to the shelf by one or more shelf clamps 1. The purpose of the clamp system 40 is to provide a connection point to connect a rack, or rack unit 55 to a shelf 20, such as in a refrigerator. The extension bar 30 is designed to extend the connection point for the rack unit 55, for example, by providing a continuous connection point across the width of the shelf 20 so that the rack unit 55 can be placed anywhere along the width of the shelf. The elongated clasp 32 may be any clasp that can provide such a continuous connection point. The elongated clasp 32 could be a continual clasp, such as the embodiment depicted in FIG. 3. In other embodiments, the elongated clasp 32 may be a series of smaller clasps positioned close together so that a user could position a rack on any portion of the shelf 20. The elongated clasp 32 may extend for the entire length of the extension bar 30. Alternatively, the elongated clasp 32 may extend only a portion of the extension bar 30, in which case the connection point for a rack 55 would be limited to only the portion of the shelf 20 over which an elongated clasp 32 extends.

Figure 3:
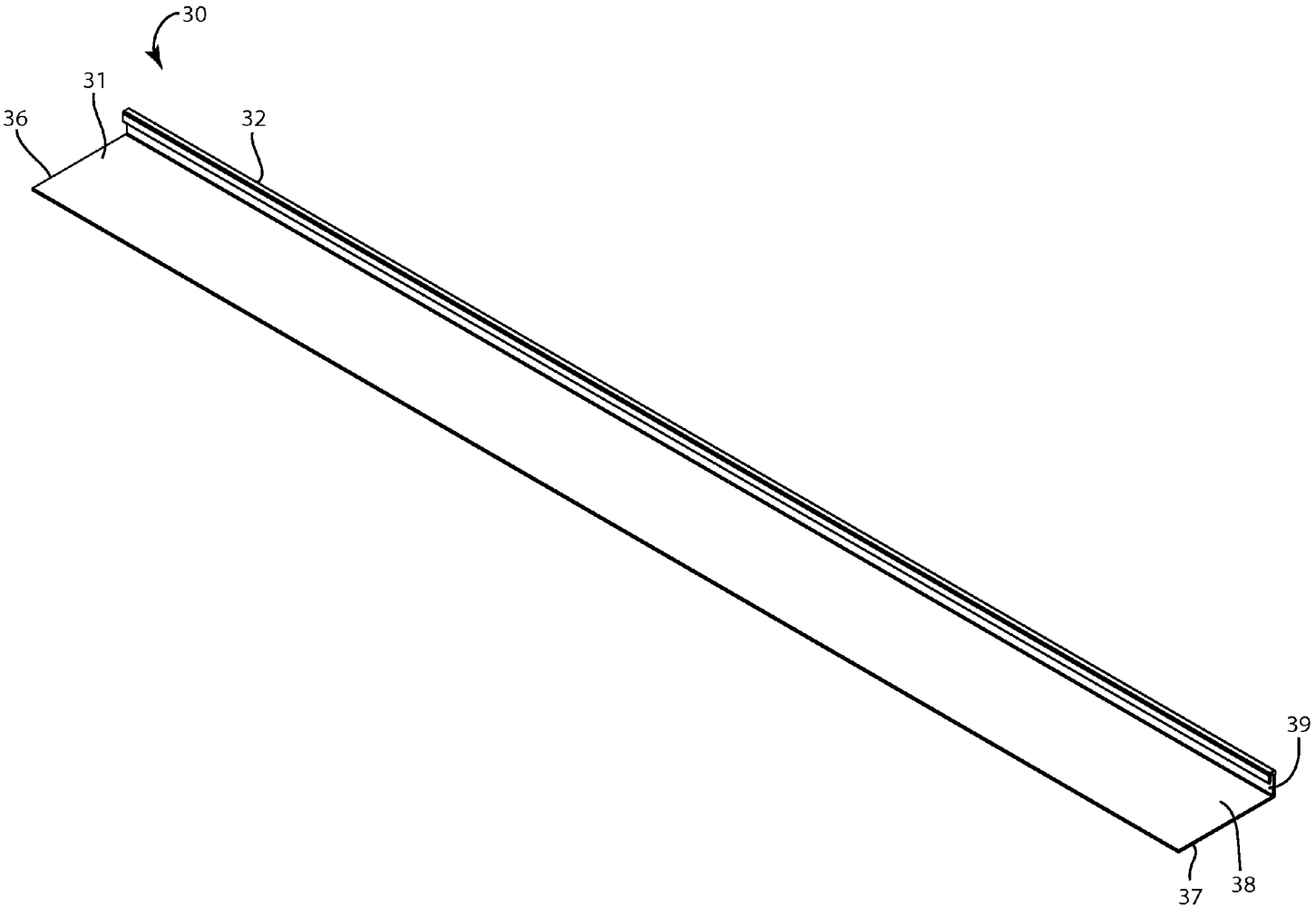
FIG. 3 illustrates an embodiment of an elongated clasp which may form part of a clamp system for connecting a rack unit to a shelf.

As shown in FIG. 3, an embodiment of the extension bar 30 has an elongated body 31 holding an elongated clasp 32. The elongated clasp is formed to connect with a connector 58 of a rack unit 55. Like the clasp 3 of the shelf clamp 1, the elongated clasp 32 of the extension bar 30 may be any clasp known in the art appropriate for removably engaging a rack unit 55. In the embodiment shown in FIG. 3, the elongated clasp 32 is a continuous right angle hook that engages, or hooks, with a connector. In the embodiment, the continuous right angle hook embodiment of the elongated clasp 32 extends from a first end 31 of the extension bar to an opposing end 37 of the extension bar 30. The right angle hook embodiment of the elongated clasp 32 has an elongated top 34 that extends perpendicularly from the top of the elongated body 31, and an elongated front 33 extending perpendicularly downward from the elongated top 34, such that the elongated top 34 and the elongated front 33 create a tight angle hook that can engage a member sized to fit therein. The elongated body 31 of the extension bar 30 may be comprised of two flat bars connected to form a right angle, including, a bottom bar 38 and a back bar 39. In the depicted embodiment, the bottom bar 38 is designed to rest directly or indirectly on the shelf 20 towards the back edge 21 such that the back bar 39 extends perpendicularly from back edge 21 of the shelf 20. The elongated clasp 32 extends from the top of the back bar 39, and thus is suspended above the back edge 21 of the shelf 20.

Figure 4:
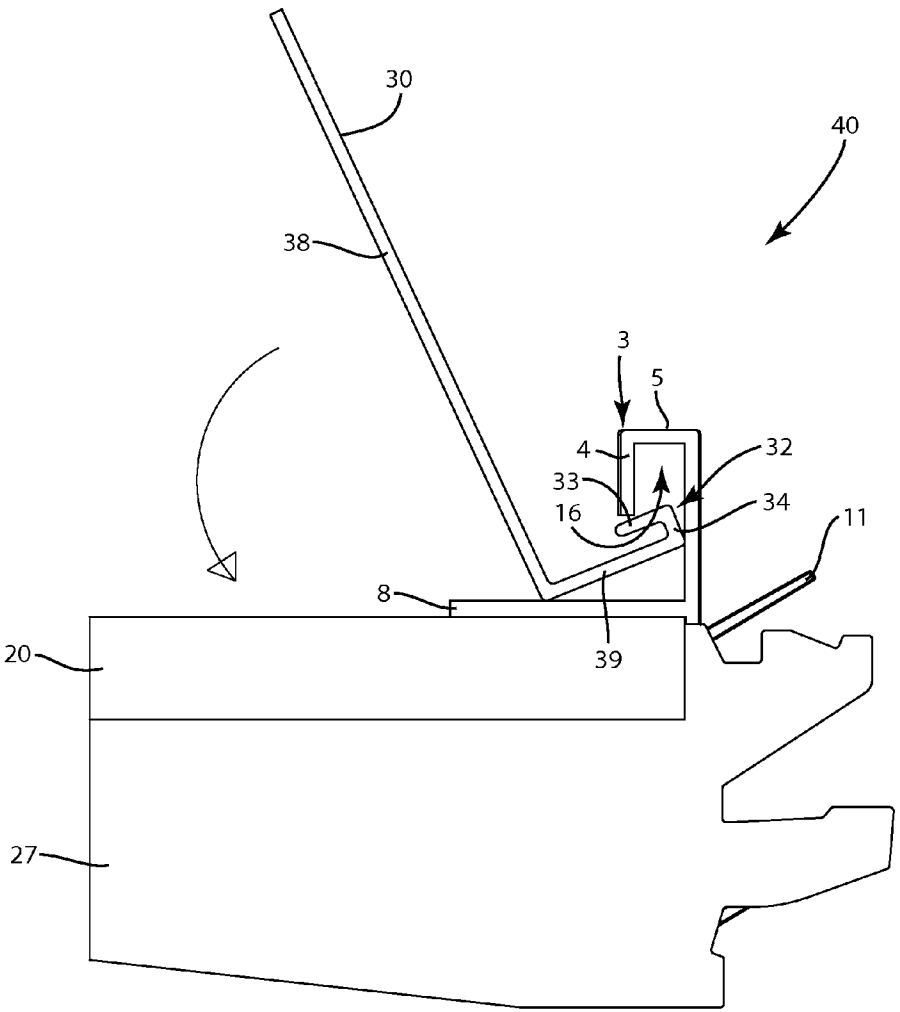
FIG. 4 illustrates an exemplary embodiment of how the shelf clamp in FIG. 1 is connected to the extension bars depicted in FIG. 3.

FIG. 4 demonstrates how the embodiment of the elongated bar 30 of FIG. 3 fastens to the embodiment of the shelf clamp 1 depicted in FIGS. 1-2. The extension bar 30 is tilted upwards and backwards so that the elongated clasp 32 can be inserted under the hook space 16 of the clasp 3 on the shelf clamp 1. The extension bar 30 is then connected to the shelf clamp 1 by tilting the extension bar 30 back down so that the elongated clasp 32 is pushed up into the clasp 3 of the shelf clamp. Thereby, the elongated clasp 32 of the extension bar 30 is secured to the shelf 20 by the shelf clamp 1. In accordance with an embodiment depicted in FIG. 4, the extension bar 30 will rest on the support lip 8 of the shelf clamp 1, which in turn will rest on the shelf 20. Further, in the depicted embodiment wherein the shelf clamp 1 and the extension bar 30 both have clasps shaped as right-angle hooks, the profile of the shelf clamp 1 and extension bar 30 will align when the shelf clamp 1 and the extension bar 30 are connected—the clasp front 4 of the shelf clamp 1 will abut and run parallel with the elongated clasp front 33 of the extension bar 30, the clasp top 5 of the shelf clamp 1 will abut and run parallel with the elongated, clasp to 34 of the extension bar 30, the top end 44 of the flat body 41 of the shelf clamp 1 will abut and run parallel with the back bar 39 of the extension bar 31, and the support lip 8 of the shelf clamp will abut and run parallel with the bottom bar 38 of the extension bar 30.

The extension bar 30 could be made of any material appropriate for the design and function described herein. For example, in a preferred embodiment, the extension bar 30 is made of PVC plastic. However, the extension bar could be made of any appropriate material, such as any plastic, metal, or wood.

In the embodiment depicted in FIGS. 3 and 4, the extension bar 30 is a separate element from the shelf clamp 1, and the shelf clamp 1 can be secured to the shelf 20 with or without connection to the extension bar 30. In an alternative embodiment, the shelf clamp 1 and the extension bar 30 are connected together as one piece. Thus, the extension bar 30 and the shelf clamp 1 may not be separated, or connected separately, to the shelf 20. In such an embodiment, the extension bar 30 and shelf clamp 1 may be formed as a single piece, such as a single piece of molded plastic. Alternatively, the extension bar 30 and shelf clamp 1 could be connected by any means known in the art, including by glue, screws, nails, welding, etc.

Figure 7A:
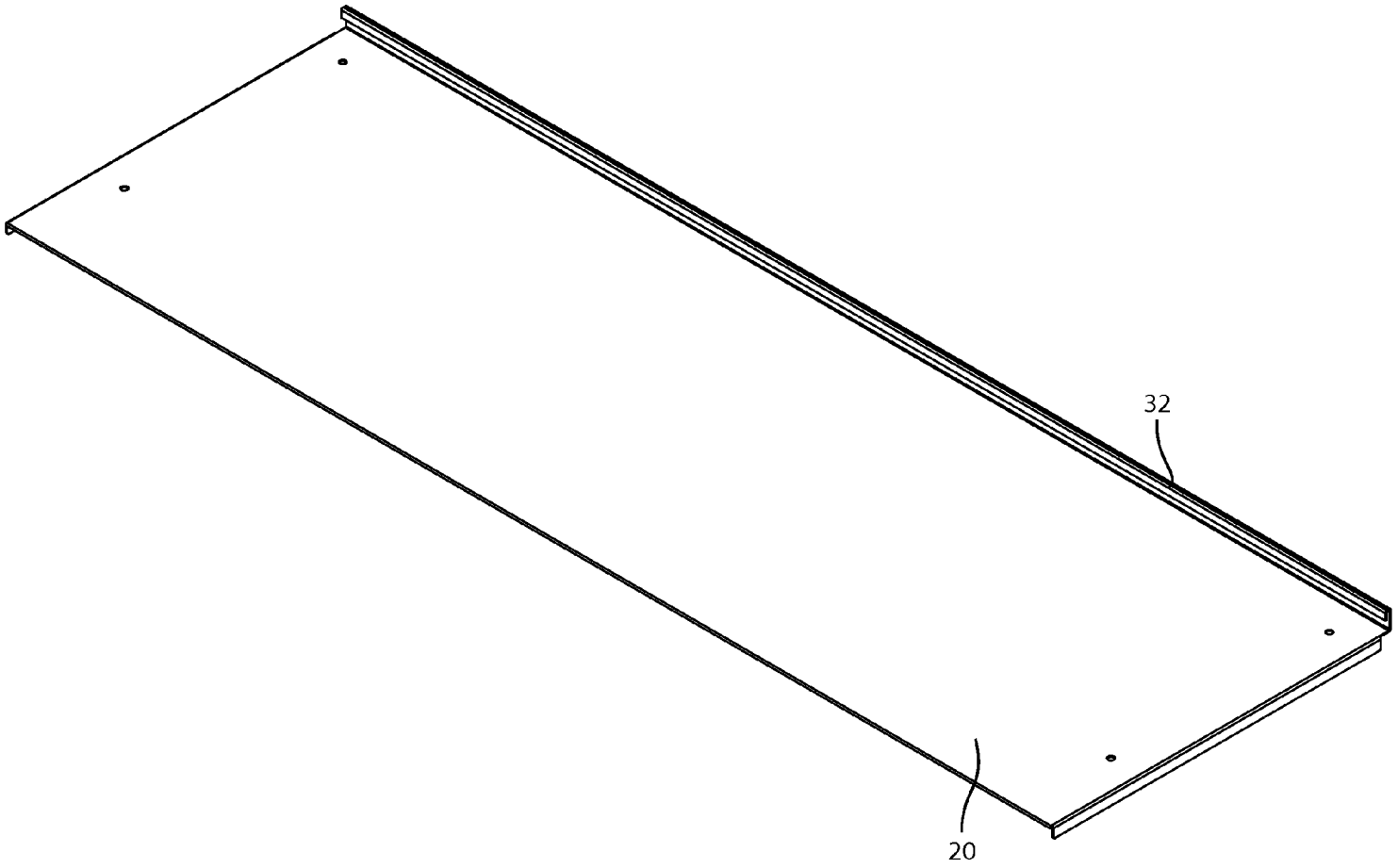
Figure 7B:
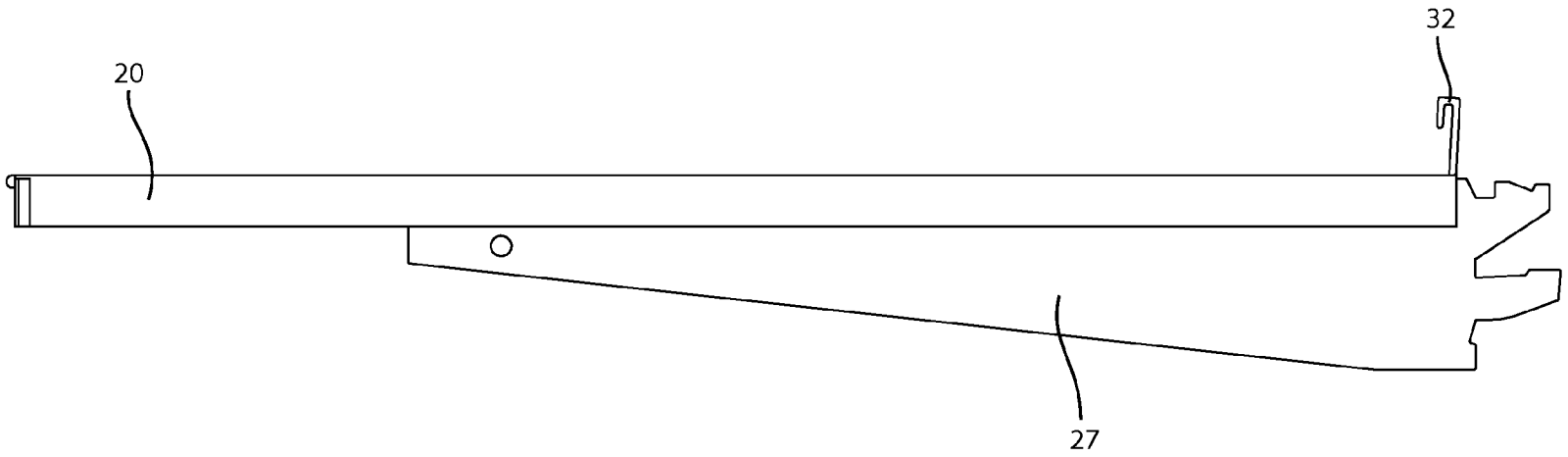

In still another embodiment, the shelf 20 may have a built-in extension bar 30 across the back thereof. According to the embodiment depicted in FIGS. 7A and 7B, a build-in extension bar 30 may extend from the back edge 21 of the shelf 20 and may provide continuous connection point for a rack unit 55. The built-in extension bar 30 could be formed with the shelf 20 as a single piece, for example as a single piece of molded plastic. Alternatively, the built-in extension bar 30 could be connected to the shelf 20 by permanent or semi-permanent means, such as by glue, screws, nails, bolts, welding, etc. In the same manner, the shelf clamp 1 could be integrated into the shelf 20, or permanently attached thereto (not shown). In an integrated embodiment, the shelf 20 and shelf clamp 1 could be formed as a single piece, for example a single piece of molded plastic. Alternatively, the shelf clamp 1 could be permanently or semi-permanently affixed to the shelf 20 such as by glue, screws, nails, bolts, or by other permanent or semi-permanent means.

Figure 5B:
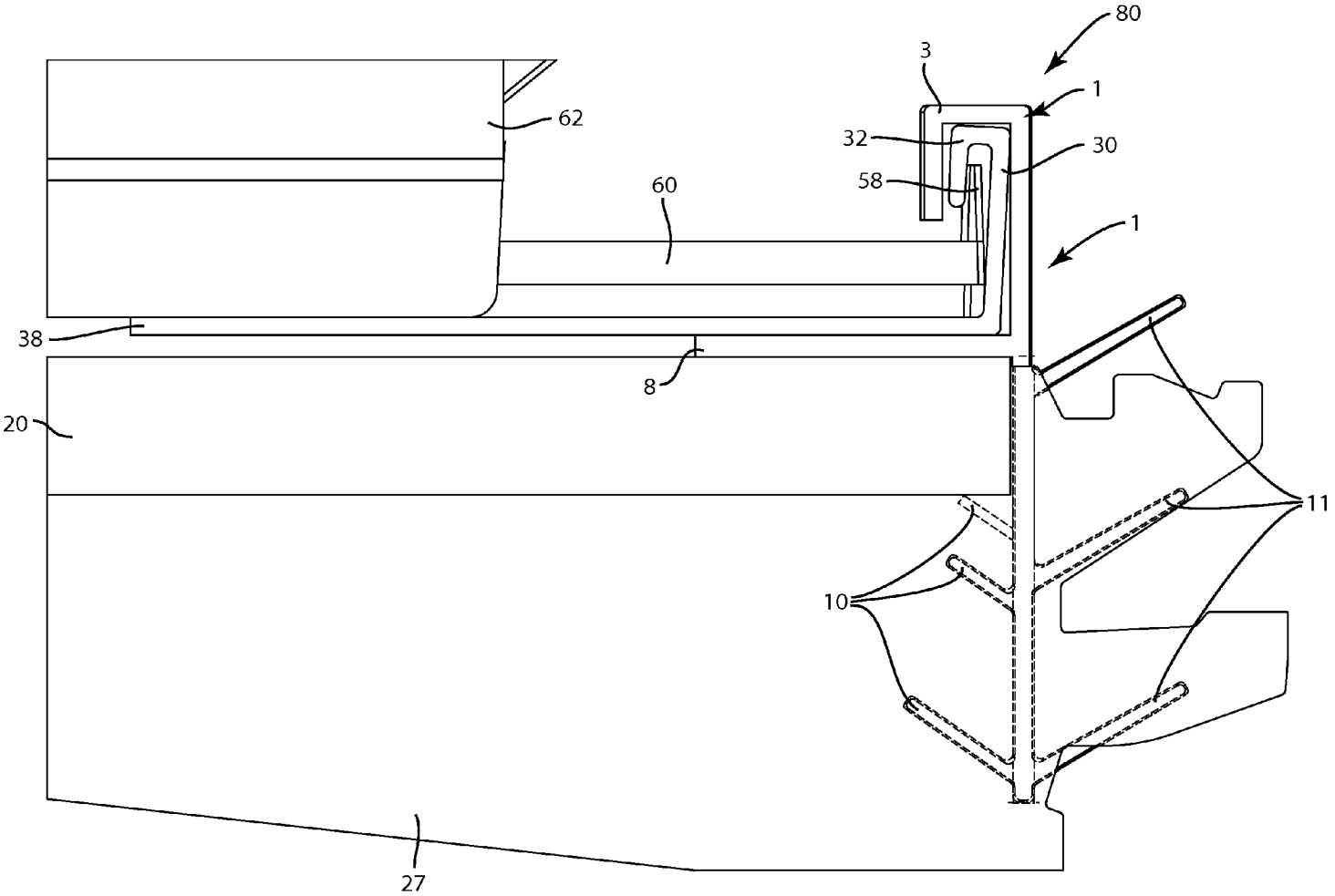
Figure 5C:
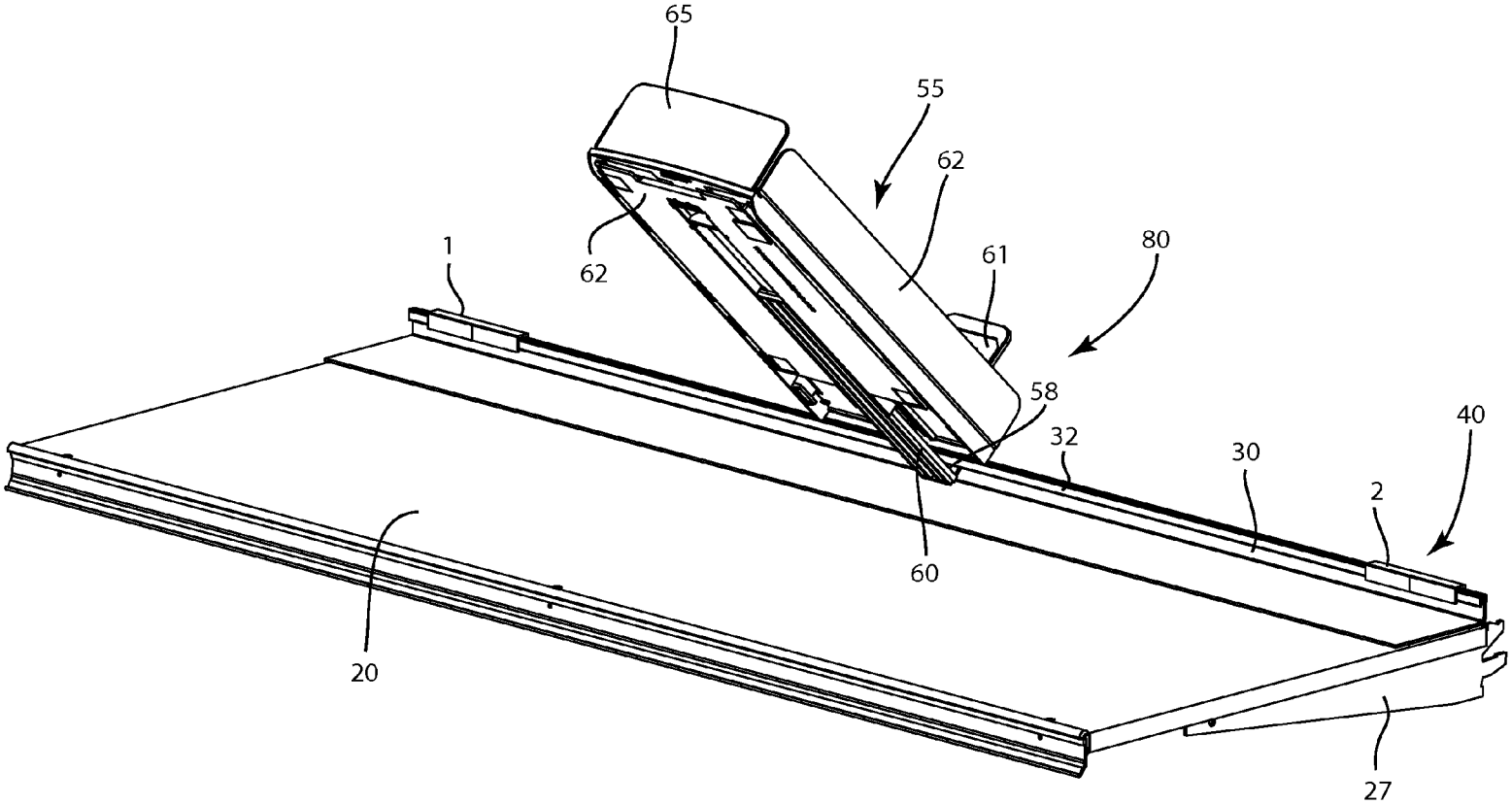
Figure 5D:
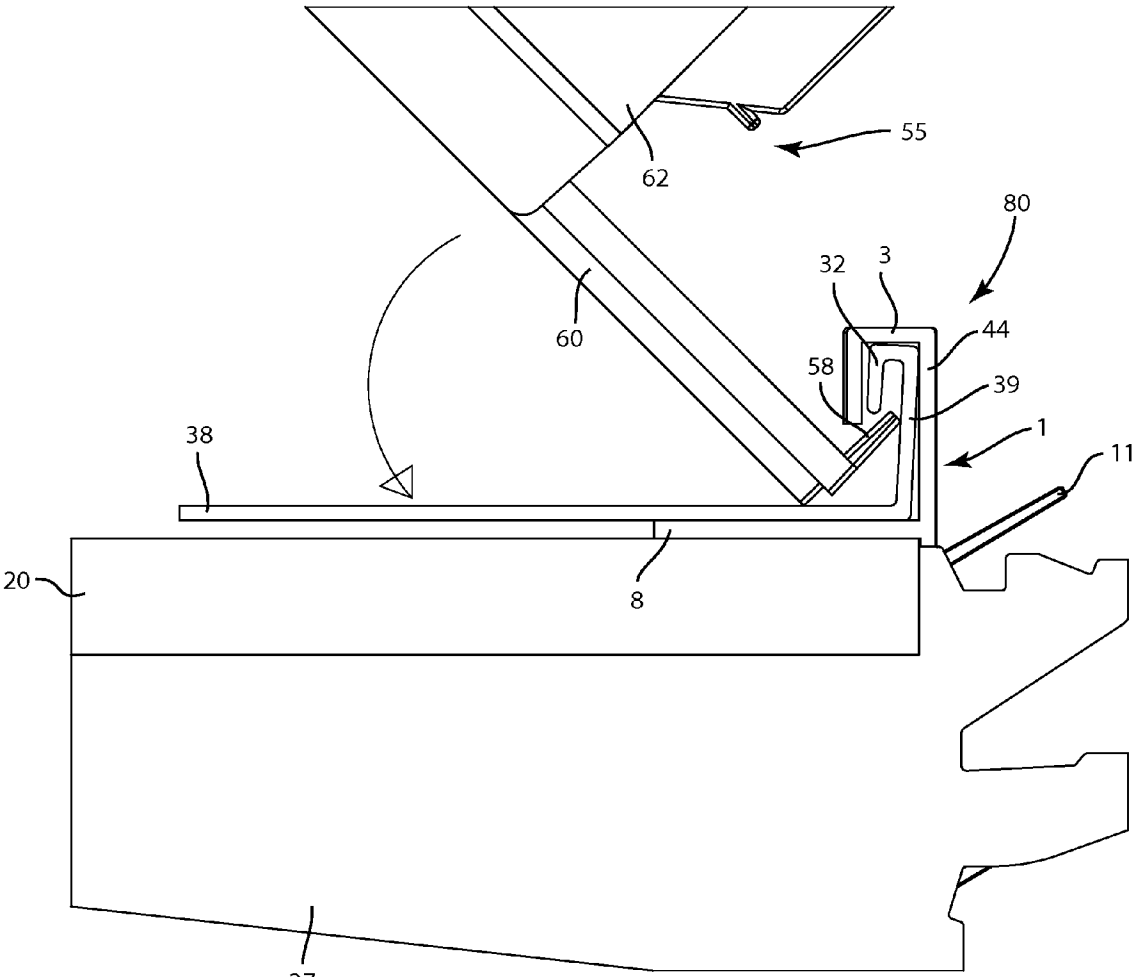
FIG. 5D illustrates a side angle view of the exemplary illustration provided in FIG. 5C.

The clamp and rack system 80 is preferably designed to be removably attachable to a shelf 20, such as in a grocer refrigerator. As illustrated FIGS. 5C and 5D, the rack unit 55 may be lifted off of the shelf for purposes of cleaning or adjustment, such as for cleaning the shelf 20 underneath the rack unit 55. Additionally, the rack unit 55 may be alternately attached to and removed from the clasp system 40 by rotating the rack unit 55 up. For example, as illustrated in FIG. 5B, the rack unit 55 is attached to the clamp system 40 by first rotating the rack unit up so that the connector 58 can slide under the clasp 3 of the shelf clamp 1 and/or the elongated clasp 32 of the extrusion bar 30. Then, once the connector 58 is positioned underneath the clasp 3 and/or 32, the rack unit 55 is rotated back down so that the connector 58 is pushed into the space inside the clasps.

Figure 6:
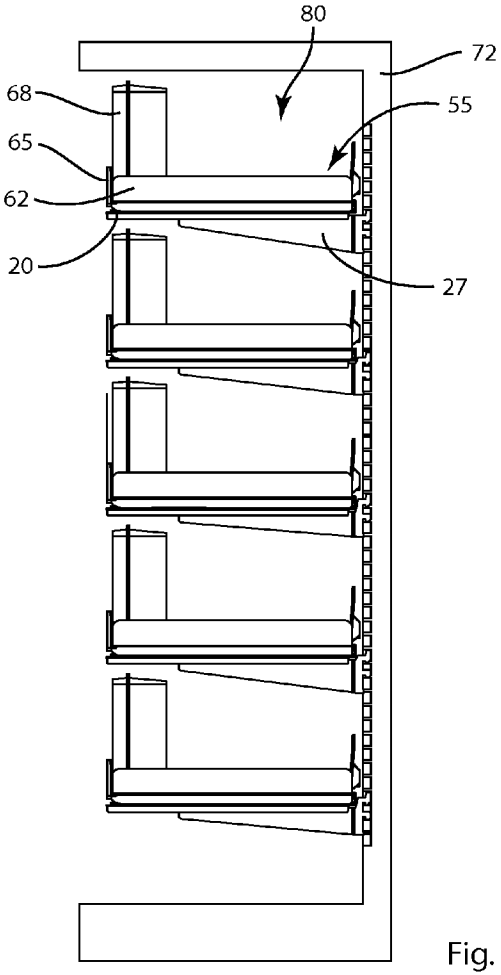
FIG. 6 illustrates a side angle view of a clamp and rack system holding packaged foods.

The clamp system 40, as previously described, clamps to a shelf 20 and offers a connection point for a connector 58 of a rack unit 55. Accordingly, the clamp and rack system 80 offers a flexible and easy way for a retailer, such as a grocer, to display packaged goods. FIG. 6 illustrates an embodiment of a clamp and rack system 80 implemented in a grocer refrigerator 72. Multiple clamp and rack systems 80 can be installed on multiple refrigerator shelves 20 so that packaged goods, such as plastic boxes of salad, can be displayed easily and efficiently. Likewise, the clamp and rack system 80 allows for multiple rack units 55 to be installed across a single shelf 20, affording maximum utilization of shelf space.

Figure 8A:
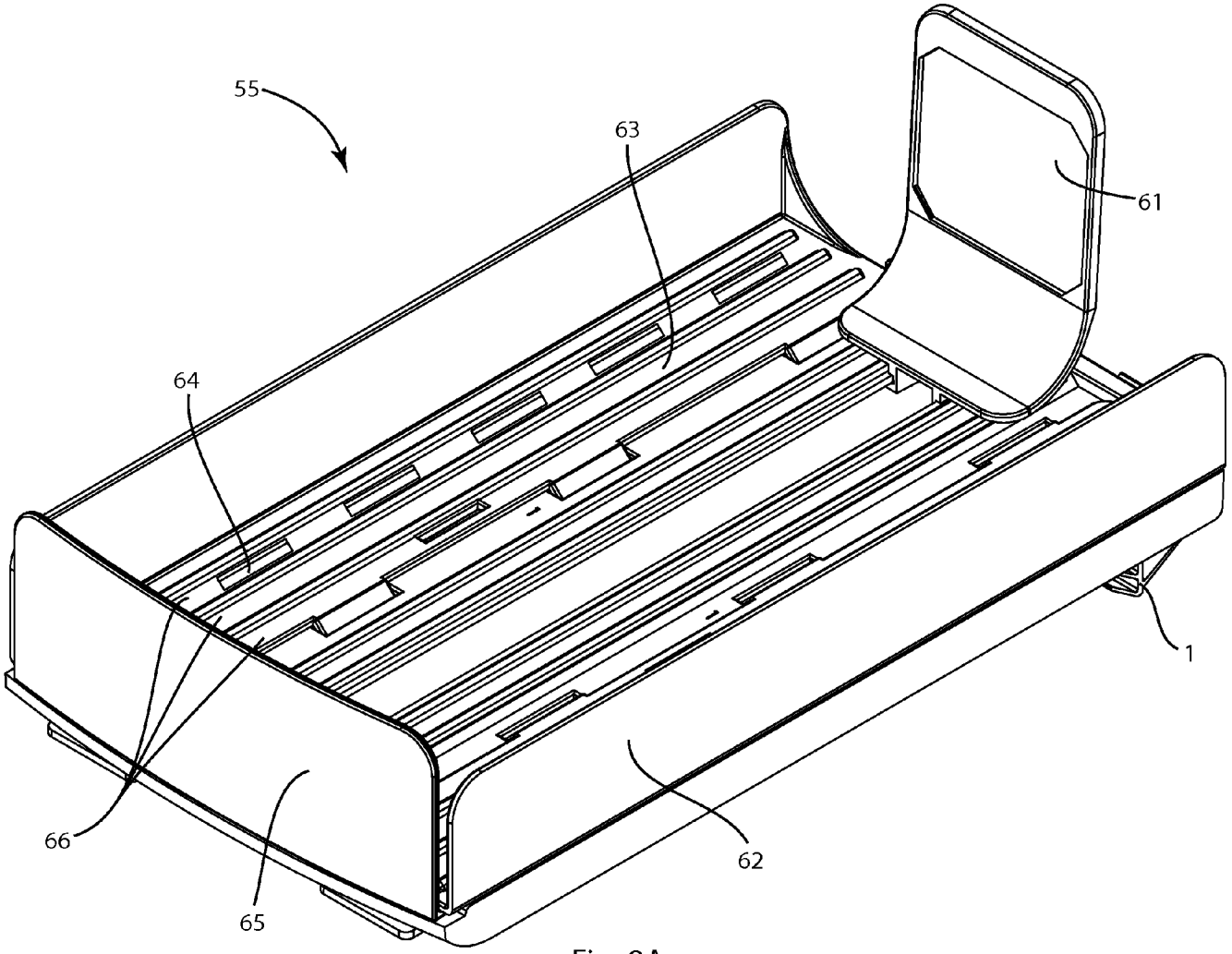
FIGS. 8A-8C illustrates an embodiment of a rack unit, as well as a clamp and rack system.
Figure 8B:
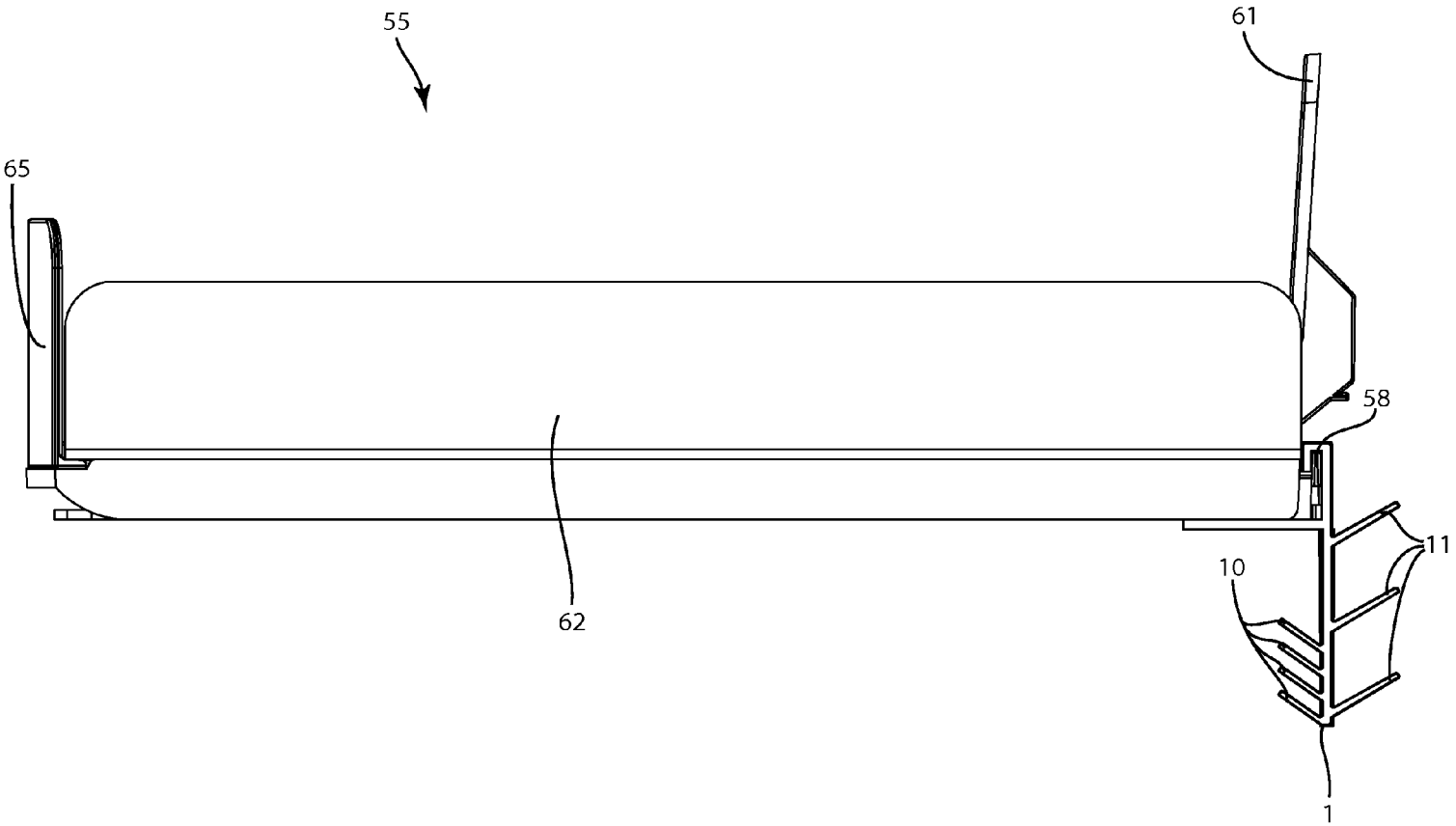
Figure 8C:
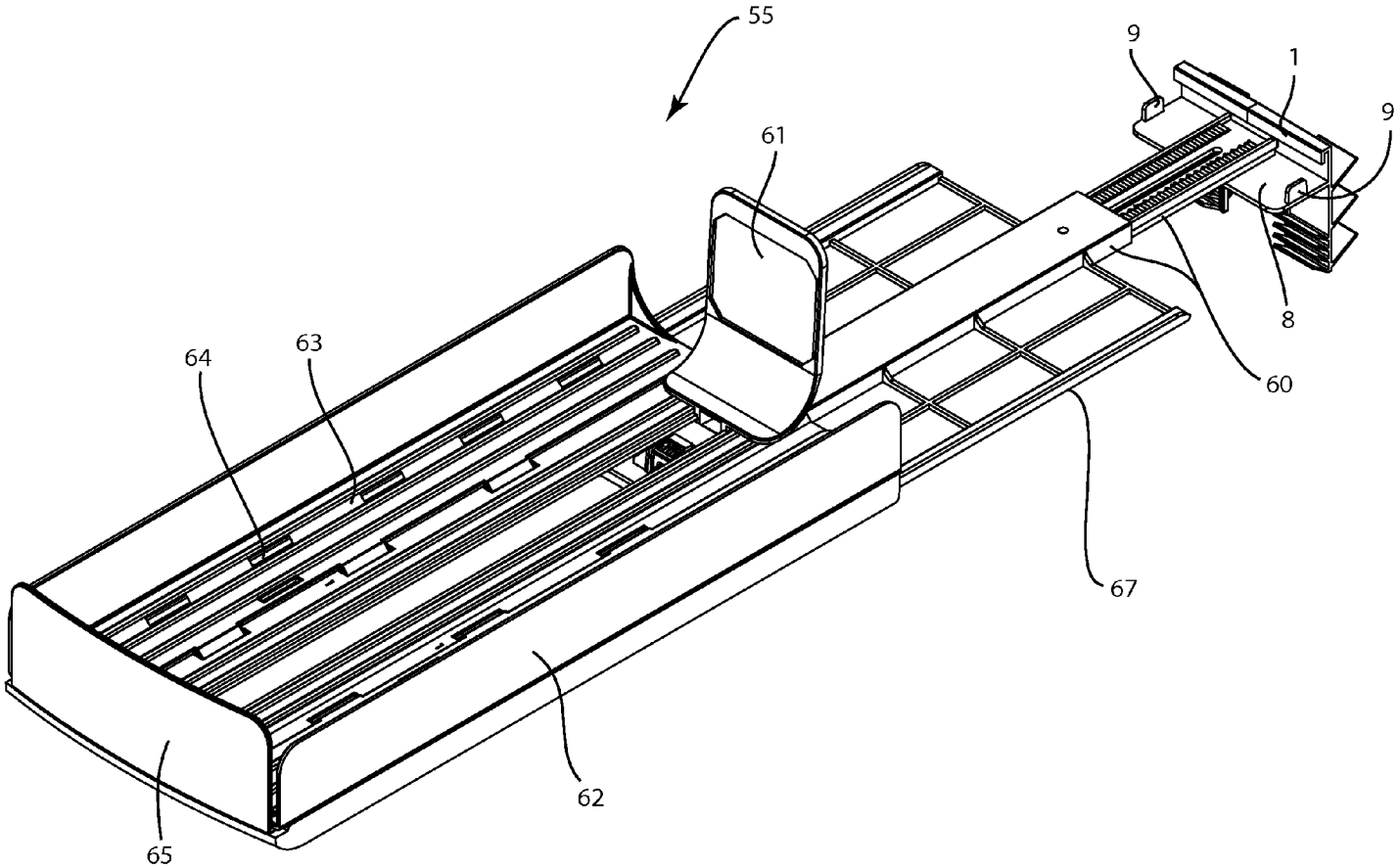

As shown in FIGS. 5A-5D, the rack unit 55 rests on a shelf 20, and is removably attached to the shelf 20 by the clamp system 40. As best seen in FIGS. 8A-8C, on embodiment of the rack unit 55 is comprised of a drawer 62 which is attached to the clamp system 40 by a telescoping arm 60 having a connector 58 at the end thereof. The telescoping arm 60 may be integrated into the rack unit 55, such as is shown in FIG. 8C. Alternatively, the telescoping arm 60 may be integrated into the shelf clamp 1. For example, the telescoping arm 60 may extend perpendicularly from the front face 42 of the flat body 41, such as from the top end 44 of thereof. The telescoping arm 60 may be selectably extendable, as is further described hereinbelow, extending out in a direction that is perpendicular from the front face 42 of the flat body 41. In such an embodiment, the clasp 3 may be connected to the end of the telescoping arm 60, and thus the connector 58 on the rack unit 55 may connect to the end of the telescoping arm 60. Thereby, the position of the rack unit 55 on the shelf 20 could be adjusted by adjusting the length of the telescoping arm 60. Alternatively or additionally, the rack unit 55 could be pulled outward, causing the telescoping arm 60 to extend outward, enabling the rack unit 55 to extend past the from edge 22 of the shelf 20 for easy loading and cleaning.

At the base of the drawer 62 is a tray 63 that functions to hold packaged foods 68, such as packaged produce, and to allow the packaged foods to slide forward along the tray 63 as the packages in the front are removed by customers. The tray 63 is preferably designed to accommodate a pusher 61, which slides down the tray 63 as packaged food is removed from the front of the drawer 62. The front of the drawer has a ledge 65, which is preferably a transparent ledge that affords customers a full view of the packaged food item 68 inside the drawer.

The pusher 61 is designed to keep the packaged food 68 toward the front of the drawer 62, and preferably press against the ledge 65. As demonstrated in FIGS. 8A-8C, the pusher may be designed to fully extend to the rear of the tray to allow for maximum pack-out without any product loss. The pusher may also be designed to stop at a specific point towards the front of the tray so that delicate produce, such as bagged salad, is not crushed by the pusher 61. The pusher 61 may be spring loaded, so that the pusher automatically slides the packaged food 68 forward in the drawer 62 when the front item is removed. The front area of the pusher 61 may be designed to receive flex in graphic materials, for example, to display the trademark of a source of the packaged food 68 held in the drawer 62.

The drawer 62 may connect to a telescoping arm 60 that allows the drawer 62 to be pulled out for easy access, such as for loading it with packaged foods 68 or for organizing packaged foods 68 in the drawer 62. FIG. 8C illustrates one embodiment of the telescoping arm 60 of the rack unit 55. The telescoping arm 60 allows the drawer 62 to glide inwards and outwards, and preferably allows for the drawer 62 to be extended out well past the front edge 22 of the shelf 20. The telescoping arm 60 also may allow adjustment of the length of the rack unit 55, so that the rack unit 55 can be fitted to shelves 20 of various depths. The telescoping arm 60 is connected at one end to the drawer 62 and at the other end to a connector 58 which attaches the rack unit 55 to the clamp system 40, which may be the shelf clamp 1 and/or the extension bar 30. As depicted in FIG. 8C, the telescoping function of the drawer may also be assisted by a slide plate 67. In such an embodiment, the telescoping arm 60 connects to a connector 58 on one end and to a slide plate 67 on the other end. The slide plate 67 may glide along the telescoping arm 60 to further allow extension of the drawer 62. The drawer 62 then connects to the slide plat 67, and glides over the slide plate 67 to allow the drawer to be pulled out, e.g., for loading products into the drawer 20. Alternatively, the slide plate 67 may be adjustably fixed to the telescoping arm 60 to adjust the length of the rack unit 55, and thereby to adjust the position of the drawer 62 on the shelf 20. In such an embodiment where the slide plate 67 is adjustably fixed to the telescoping arm 60, the pull action function of the drawer 62 could occur by sliding the drawer 62 on the slide plate 67.

As seen in FIG. 8C, an embodiment of the shelf clamp 1 may have stabilizing, tabs 9 on either side of the support lift 8 which can press against the sides of the telescoping arm 60 when the telescoping arm is in its retracted position. Thereby, the stabilizing, tabs 9 can provide further stabilization of the rack unit 55 so that the rack unit 55 does not shift or tilt in response to a sideways force. Thereby, a drawer 62 remains secured to the shelf 20 at all times, including when it is pulled out for stocking. Also, the rack unit 55 permits easy loading and organization by anyone standing in front of, for example, a grocer refrigerator case. Preferably, the rack unit 55 is designed such that the pusher 61 stays back when the drawer 62 is pulled out. This makes for easier stocking and organization of packaged foods 68 in the drawer 62.

As shown in FIG. 8A, an embodiment of the drawer 62 has a tray 63 with one or more channels 66 designed to allow the circulation of air, such as to allow refrigerated air to move from the rear of a refrigerated case to the front of the case area. The one or more channels 66 provide a void space across the length of the drawer 62 through which air can move underneath the packaged food 68. Thereby, a tray 63 may provide for better air circulation around the packaged foods 68 to keep the packaged foods 68 cooler and fresher. Additionally, the tray 63 may have one or more vents 64 in the channels 66 which further promote air flow. Likewise, the sides or ledge 65 of the tray may also have vents to promote air flow. As shown in FIG. 8A, the sides and ledge 65 of the drawer 62 may be disassociated, to provide a space between the sides of the drawer, and the ledge 65 of the drawer so that air can flow therethrough. Finally, as also shown in FIGS. 8A-8C, the drawer 62 may have a minimal or non-existence backside, which further promotes maximal air flow through the channels 66 and past the packaged food 68.

It will thus be seen that the present disclosure describes merchandising devices and systems for holding and displaying merchandise, and more specifically, for merchandising units and systems for displaying packaged foods on shelves in a grocery store. This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements within substantial differences from the literal language of the claims.

We claim:

1. A shelf clamp for connecting a rack unit to a display shelf, the shelf clamp comprising:

a flat body having a front face and a back face, a top end and a bottom end; a clasp extending frontward at an angle from the top end of the flat body and fashioned to connect to an object; a support lip extending generally perpendicular and frontward from a mid-section of the flat body;

a front fin extending diagonally upward from the front face of the flat body and comprised of flexible material such that the front fin can flex upward toward the flat body;

wherein the bottom end of the shelf clamp is fashioned to slide down between an edge of a shelf and a wall, causing the front fin to flex toward the flat body as it passes between the shelf and the wall, and then return to its diagonally upward position once it passes the shelf, such that the shelf clamp engages the edge of the shelf between the support lip and the front fin.

2. The shelf clamp of claim 1, wherein the clasp connects to a connector on a rack unit to fasten the rack unit to the shelf, wherein the rack unit is for merchandising packaged food.

3. The shelf clamp of claim 2, wherein the clasp is a female connector configured to receive a male connector of the rack unit.

4. The shelf clamp of claim 1, wherein the clasp is a right angled hook having a top side that extends perpendicularly from the top end of the flat body and a front side that extends perpendicularly downward from the top side.

5. The shelf clamp of claim 4, wherein the shelf clamp fastens a rack unit to the shelf by the right angle hook receiving a rectangular-shaped male connector on the rack unit.

6. The shelf clamp of claim 1 further comprising a back fin extending diagonally upward from the back face of the flat body such that the back tin engages the wall when the shelf clamp engages the edge of the shelf.

7. The shelf clamp of claim 1, where in the shelf clamp is made of molded polypropylene.

8. The shelf clamp of claim 1, wherein the bottom end of the flat body comprises two legs that extend downward, and wherein the front fin extends from a front side of at least one of the legs.

9. The shelf clamp of claim 1, wherein the support lip is a rigid piece that extends perpendicularly from the flat body.

10. The shelf clamp of claim 6 further comprising at least two front fins extending from the front side of the flat body and at least two back fins extending from the back side of the flat body.

11. The shelf clamp of claim 1 further comprising, a telescoping arm extending perpendicularly from the top end of the flat body, the telescoping arm having a first end connected to the clasp and a second end that is extendable in a direction perpendicular to the front face of the shelf clamp.

12. The shelf clamp of claim 1 further comprising an extension bar that connects to the clasp of the shelf clamp, the extension bar being an elongated body having an elongated clasp extending thereacross and providing a continuous connection point for attaching a rack unit to the shelf.

13. The shelf clamp of claim 12 wherein the connection point provided by the elongated clasp is a female connection point configured to receive a male connector on a rack unit.

14. The shelf clamp of claim 12 wherein the elongated clasp of the extension bar is a right angled hook having a top side that extends perpendicularly from a top end of the elongated body and it front side that extends perpendicularly downward from the top side.

15. A shelf clamp system for connecting a rack unit to a display shelf, the shelf clamp system comprising:

a shelf with a front edge, a back edge, a top surface and a bottom surface; and a first shelf clamp comprising:

a flat body having a front face and a back face, a top end and a bottom end; a clasp extending frontward at an angle from the top end of the flat body and fashioned to connect to an object; a support lip extending generally perpendicular and frontward from a mid-section of the flat body;

a front fin extending diagonally upward from the front face of the flat body and comprised of flexible material such that the front fin can flex upward toward the flat body;

wherein the bottom end of the shelf clamp is fashioned to slide down between an edge of the shelf and a wall, causing the front fin to flex toward the flat body as it passes between the shelf and the wall, and then return to its diagonally upward position once it passes the shelf, such that the shelf clamp engages the edge of the shelf between the support lip and the front fin.

16. The shelf clamp of claim 15 further comprising a back fin extending diagonally upward from the back face of the body such that the back in engages the wall when the shelf clamp engages the shelf.

17. The shelf clamp of claim 15 further comprising a back fin extending diagonally upward from the back face of the body such that the back fin engages the wall when the shelf clamp engages the shelf.

18. The shelf clamp of claim 15 wherein the shelf clamp is configured to receive a connector of a rack unit for holding packaged foods to removably connect the rack unit for holding packaged foods to the shelf.

19. The shelf clamp of claim 15 further comprising an extension bar, the extension bar comprising an elongated body having an elongated clasp extending thereacross, the elongated clasp resiliently received within the clasp of the shelf clamp and the elongated body engaging the support lip and extends along the top surface of the shelf beyond the support lip.

20. The shelf clamp of claim 19 wherein the elongated clasp of the extension bar is configured to receive a connector of the rack unit.

21. The shelf clamp of claim 20 wherein the clasp of the shelf clamp is a right angled hook having a top side that extends perpendicularly from the top end of the body and a front side that extends perpendicularly downward from the top side;

wherein the elongated clasp of the extension bar is configured to fit inside the clasp of the shelf clamp and has an elongated top side that extends perpendicularly from a top end of the elongated body; and wherein the extension bar fastens the rack unit to the shelf by the elongated clasp receiving a male connector on the rack unit.

22. The shelf clamp of claim 19 wherein the extension bar and the shelf clamp are one inseparable piece.

23. The shelf clamp of claim 19 wherein the extension bar removably connects to the shelf clamp.

24. The shelf clamp of claim 22 wherein the extension bar and the shelf clamp are formed as a single piece of molded polypropylene.

25. A shelf clamp for connecting a rack unit to a display shelf, the shelf clamp comprising:

a flat body having a front face and a back face, and a top end and a bottom end separated by a midsection of the flat body, the flat body having two spaced apart legs that extend downward from the mid-section;

a clasp extending from the top end of the flat body;

a support lip extending from the mid-section of the flat body; and at least one front fin extending diagonally upward from the front face of each respective leg of the flat body and at least one back fin extending diagonally upward from the back face of each respective leg of the flat body, wherein the front fins and back fins are comprised of a flexible material such that each front fin and each back fin can flex upward toward the flat body;

wherein when in use the legs of the shelf clamp slide down between an edge of a shelf and a wall, causing the front fins to flex toward the flat body as it passes between the shelf and the wall, and then return to its diagonally upward position once it passes the shelf, such that the shelf clamp engages a back edge of the shelf between the support lip and the front fin, wherein and each back fin engages and pushes out against the wall when the shelf clamp engages the edge of the shelf in order to keep the shelf clamp engaged with the shelf and secure the shelf clamp to the shelf.

* * * * *